US006106193A

United States Patent [19]

Allen et al.

[11] Patent Number: 6,106,193

[45] **Date of Patent: *Aug. 22, 2000**

[54] HYDRAULICALLY DRIVEN, MULTIPLE ROTOR RIDING TROWEL

[75] Inventors: J. Dewayne Allen, Paragould, Ark.; Michael W. McKean, Arlington, Tenn.; Timmy D. Guinn, Paragould; Hugh L. Adams, Bassett, both of Ark.

[73] Assignee: Allen Engineering Corporation, Paragould, Ark.

[ * ] Notice: This patent is subject to a terminal disclaimer.

[21] Appl. No.: 09/119,272

[22] Filed: Jul. 20, 1998

Related U.S. Application Data

[63] Continuation-in-part of application No. 08/784,244, Jan. 15, 1997, Pat. No. 5,890,833.

[51] Int. Cl.[7] ..... E01C 19/22

[52] U.S. Cl. ..... 404/112

[58] Field of Search ..... 404/112

[56] References Cited

U.S. PATENT DOCUMENTS

| | | | |
|---|---|---|---|
| 3,936,212 | 2/1976 | Holz, Sr. et al. | 404/112 |
| 3,973,857 | 8/1976 | Whiteman, Jr. | 404/112 |
| 4,027,991 | 6/1977 | Maass | 404/112 |
| 4,046,483 | 9/1977 | Sutherland | 404/112 |
| 4,046,484 | 9/1977 | Sutherland | 404/112 |
| 4,232,980 | 11/1980 | Tertinek et al. | 404/112 |
| 4,629,359 | 12/1986 | Sengupta | 404/112 |
| 4,673,311 | 6/1987 | Whiteman, Jr. | 404/112 |
| 5,108,220 | 4/1992 | Allen et al. | 404/112 |
| 5,405,216 | 4/1995 | Allen et al. | 404/112 |
| 5,480,257 | 1/1996 | Allen | 404/112 |
| 5,480,258 | 1/1996 | Allen | 404/112 |
| 5,613,801 | 3/1997 | Allen | 404/112 |
| 5,685,667 | 11/1997 | Allen | 404/112 |
| 5,816,739 | 10/1998 | Allen | 404/112 |
| 5,899,292 | 5/1999 | Paul et al. | 180/403 |

*Primary Examiner*—Eileen Dunn Lillis
*Assistant Examiner*—Raymond Addie
*Attorney, Agent, or Firm*—Stephen D. Carver

[57] ABSTRACT

High performance, multiple rotor riding trowels for finishing concrete comprise hydraulic circuitry enabling complete joystick control to the operator. The rigid trowel frame mounts separate spaced-apart, downwardly-projecting, bladed rotor assemblies that frictionally engage the concrete surface. The rotor assembly blades finish the surface while supporting the trowel. The rotor assemblies are tilted with double acting, hydraulic cylinders to effectuate steering and control. Double acting hydraulic cylinders also control blade pitch. Separate gimbaled, hydraulic motors revolve each rotor assembly. A joystick system enables operator hand control with minimal physical exertion. The joystick system activates electrical circuitry that fires solenoid control valves to energize various hydraulic cylinders that tilt the rotors and alter blade pitch. The hydraulic steering control circuit driven by a motor driven pump pressures a flow divider circuit to control the solenoid tilt control valves. A bypass-valve in line before the flow divider enables an operator to customize the trowel steering speed. A motor drive control circuit responsive to a hydraulic pump controls each hydraulic drive motor, and provides for speed control and heat dissipation.

7 Claims, 13 Drawing Sheets

HYDRAULICALLY DRIVEN, MULTIPLE ROTOR RIDING TROWEL

CROSS-REFERENCE TO RELATED APPLICATION

This application is a continuation in part of prior U.S. application, Ser. No. 08/784,244, Filed Jan. 15, 1997, and entitled Hydraulically Controlled Riding Trowel, now U.S. Pat. No. 5,890,833, issued Apr. 6, 1999.

BACKGROUND OF THE INVENTION

1. Field of the Invention

This invention relates generally to motorized riding trowels for finishing concrete surfaces of the type classified in United States Patent Class 404, Subclass 112. More particularly, our invention relates to multiple-rotor, hydraulically driven riding trowels.

2. Description of the Prior Art

It is well established in the concrete finishing arts that freshly placed concrete must be appropriately finished to achieve the desired smoothness and flatness. As freshly poured concrete "sets", it soon becomes hard enough to support the weight of motorized riding trowels, that are particularly effective for finishing concrete. Motorized riding trowels are ideal for finishing large areas of plastic concrete quickly and efficiently, and a variety of riding trowels are known in the art.

Typical riding trowels employ multiple, downwardly projecting rotors that contact the concrete surface and support the weight of the trowel. A typical rotor comprises a plurality of radially spaced apart finishing blades that revolve in frictional contact with the concrete surface. The blades may be coupled to circular finishing pans for treating green concrete. When the rotors are tilted, steering and propulsion forces are frictionally developed by the blades (or pans) against the concrete surface. Riding trowels finish large surface areas of wet concrete more efficiently than older "walk behind" trowels. Significant savings are experienced by the contractor using such equipment, as time constraints and labor expenses are reduced.

Preferably, the finishing process starts with panning while the concrete is still "green", within one to several hours after pouring depending upon the concrete mixture involved. The advent of more stringent concrete surface finish specifications using "F" numbers to specify flatness (ff) and levelness (fl), dictates the use of pans on a widespread basis. Both "super-flat" and "super-smooth" floors can be achieved by panning with motorized trowels.

Pan finishing is normally followed by medium speed blade finishing, after the pans are removed from the rotors. A developing technique is the use of "combo blades" during the intermediate "fuzz stage" as the concrete continues to harden. So-called "combo-blades" are a compromise between pans and normal finishing blades. They present more surface area to the concrete than normal finishing blades, and attack at a less acute angle. The rotors are preferably turned between 100 to 135 RPM at this time. Finishing blades are then used, and they are rotated between 120 to 150 RPM. Finally, the pitch of the blades is changed to a relatively high contact angle, and burnishing begins. Rotor speeds of between 135 and 165 RPM are recommended in the final trowel finishing stage.

Holz, in U.S. Pat. No. 4,046,484 shows a pioneer, twin rotor, self-propelled riding trowel wherein the rotors are tilted to generate steering forces. U.S. Pat. No. 3,936,212, also issued to Holz, shows a three rotor riding trowel powered by a single motor. Although the designs depicted in the latter two Holz patents were pioneers in the riding trowel arts, the devices were difficult to steer and control.

Prior U.S. Pat. No. 5,108,220 owned by Allen Engineering Corporation, the same assignee as in this case, relates to an improved, fast steering system for riding trowels. Its steering system enhances riding trowel maneuverability and control. The latter fast steering riding trowel is also the subject of U.S. Des. Pat. No. 323,510 owned by Allen Engineering Corporation.

U.S. Pat. No. 5,613,801, issued Mar. 25, 1997 to Allen Engineering Corporation discloses a power-riding trowel equipped with separate motors for each rotor. Steering is accomplished with structure similar to that depicted in U.S. Pat. No. 5,108,220 previously discussed.

Allen Engineering Corporation U.S. Pat. No. 5,480,258 discloses a multiple engine riding trowel. The twin rotor design depicted therein associates a separate engine with each rotor. As the engines are disposed directly over each revolving rotor assembly, horsepower is more efficiently transferred to the revolving blades. Besides resulting in a faster and more efficient trowel, the design is easier to steer. Again, manually activated steering linkages are used.

Allen Engineering Corporation U.S. Pat. No. 5,685,667 discloses a twin engine riding trowel using "contra rotation." Many trowel users prefer the steering characteristics that result when the trowel rotors are forced to rotate in a direction opposite from that normally expected in the art.

While modern, high power riding trowels are noted for their speed and efficiency, extreme demands are placed upon the relatively small, internal combustion motors that power such machines. Adequate horsepower must be available at all times for the rotors, that must operate under varying conditions of speed, drag, rotor tilt-angle, blade pitch, and concrete hardness. Demands upon drive motors can vary widely when switching between panning and blade-finishing modes. Generally speaking, the more powerful the trowel, the faster finishing operations can be completed. However, optimum engine speed (i.e., for rated torque and horsepower) is limited to a relatively small RPM range. On the other hand, a variety of blade speeds are required for modern finishing, and as explained earlier, load conditions vary widely as well. Engine RPM is usually the key variable related to output power. Typical riding trowel engines are coupled through belts and pulleys to gear boxes connected to the rotor shafts. The output shaft speed (i.e., rotor speed) is geared down, with a ratio of 20:1 being common. While it is recognized that effective motor output characteristics are RPM related, the use of fixed ratio reduction gearing often results in a mismatch between the desired blade speed, the frictional load, and the available motor horsepower at a given RPM.

If engine speed increases too much, excessive power may be developed, and the finishing mechanism may rotate too fast. For example, the initial panning stage requires relatively high power because of the viscous character of green concrete, but relatively low rotor speeds are desired. Since the rotors are driven through a fixed ratio established by the gearbox, belts and drive pulleys, optimum engine power often cannot be obtained during panning without risking excessive rotor speeds.

It is thus desirable to provide a riding trowel wherein the engine and gear boxes can operate at ideal speeds over a wide range of finishing conditions. One solution pioneered by Allen Engineering Corporation, is the subject of pending U.S. patent application Ser. No. 09/008,355, filed Jan. 16, 1998, and entitled "Riding Trowel with Variable Ratio Transmission." The object is to vary the overall drive gear ratio during different panning and blade finishing stages so that motors may operate within optimum RPM ranges as much as possible. In the Allen design, the effective drive ratio established between the motor output pulleys and the drive pulleys splined to the gearbox input shaft can be dynamically varied. However, since the rotor gearbox reduction ratio is still fixed, the range of adjustment of the overall drive train gear ratio (i.e., the ratio between motor RPM and rotor RPM) is limited. What appears necessary is a variable ratio "drive gear" for revolving the rotors that allows the motors to maintain a relatively constant speed over a variety of working conditions and loads. Although hydraulic motors would seem logical, their practicality has hitherto been limited by the steering and handling characteristics of motorized trowels, and the available engine horsepower.

Many early riding trowels use manually operated levers for steering. The steering levers project upwardly from the frame and are grasped and manipulated by the operator to direct the machine. The steering levers deflect linkages below the trowel frame to tilt the rotors. Often a vigorous physical effort is required. Where separate engines are used with each rotor assembly, additional physical effort is required to tilt the rotors for steering, or to vary blade pitch. It has now been established that modern, state-of-the art riding trowels require power steering for maximum performance. Hydraulic steering systems for multiple engine trowels previously proposed by Allen Engineering Corporation have proven desirable. For example, copending Allen Engineering Corporation patent application Ser. No. 08/784,244, filed Jan. 15, 1997, entitled "Hydraulically Controlled Riding Trowel" discloses a powered steering system for riding trowels. Quick, responsive handling optimizes trowel efficiency, and preserves operator safety and comfort.

At the same time, power steering requires added hydraulic motors and accessories that increase the demand for motor horsepower. Hydraulic steering devices consume energy, further aggravating the need for power and optimal motor control. In other words, internal combustion engine drive speed should be maintained within an optimal RPM range to supply adequate horsepower. But, as explained earlier, the overall drive train gear ratio limits motor performance. By using hydraulic motors to drive trowel rotors, the internal combustion motors may operate continuously within ideal RPM ranges. The resultant horsepower increase more than offsets losses caused by hydraulic inefficiencies. Concomitantly, the added weight resulting from hydraulic drive motors and required accessories further burdens the steering system. The heavier and more powerful the trowel, the more important it is to establish responsive steering and fast, effective handling.

Hence we have designed a multiple-rotor, hydraulically driven trowel. In the best mode the hydraulic drive system is employed with an optimized steering control system.

SUMMARY OF THE INVENTION

The preferred trowel comprises a plurality of spaced apart rotors gimbaled to the frame. One or more internal combustion motors power suitable hydraulic pumps for energizing hydraulic accessories. The rotors are powered and directly driven hydraulically, so mechanical gearboxes are avoided. In the best mode an "electric-over-hydraulic" system effectuates steering and maneuvering. The preferably gasoline or diesel powered internal combustion motors operate over an optimized RPM range. Joysticks, conveniently placed near the operator, initially activate the electrical circuitry that, in turn, activates hydraulic components to tilt the rotors for steering and maneuvering the trowel, and for changing blade pitch. The enhanced steering system and the hydraulic drive system compliment one another, as the hydraulic drive system allows the internal combustion motors to run at an optimum speed, making horsepower readily available. The extra horsepower adequately powers the energy demands of the hydraulic accessories. The increased weight and horsepower of the system demands an improved steering design, and our preferred hydraulic steering system readily delivers the enhanced functional characteristics that make hydraulic drive practicable.

Thus a fundamental object of our invention is provide a workable hydraulic direct drive system for riding trowels.

Another fundamental object of our invention is provide a hydraulic direct drive system adapted for multiple engine riding trowels.

Another important object is to provide power steering and power blade pitch control for use with hydraulic, direct drive riding trowels.

A further object is to provide an electrical-over-hydraulic steering and control system for riding trowels that is lever or joystick controlled.

Another important object is to simplify the operation of high power, dual or triple rotor trowels.

A related object is to reduce the physical effort required to safely drive a twin-rotor or triple-rotor riding trowel.

Another basic object is to provide a direct drive system and a complimentary power steering system for high power riding trowels characterized by multiple rotor assemblies.

It is also an object to provide hydraulic power steering and direct hydraulic drive for twin-engine and triple engine riding trowels. Similarly, it is an object to provide hydraulic steering and hydraulic direct drive systems that are effective over a wide variety of operating conditions.

A further object is to provide a multiple rotor riding trowel characterized by direct hydraulic drive and hydraulic steering that readily handles conventional blades, combo-blades, or finishing pans.

A still further object is to provide a hydraulic control circuit of the character described that will function on a variety of riding trowels, including diesel or gasoline powered trowels with either one or two motors.

Another object is to provide a high power riding trowel that overcomes power-draining vacuum effects that occur when panning wet concrete.

Another fundamental object is to independently, hydraulically control each of the rotors in a twin-rotor trowel.

A related object is to provide an electrical control system for actuating the hydraulic system in a twin-rotor trowel. It is a feature of this invention that "joystick steering" is employed for ultimate trowel ride control in conjunction with the hydraulics.

Another basic object is to provide a hydraulic direct drive system for multiple rotor riding trowels that performs with either standard rotation or contra rotation.

Another basic object is to provide a functional, hydraulic drive system for riding trowels that enables directional and variable speed control, while applying relatively constant torque under varying speed conditions.

A still further object is to provide a direct drive hydraulic system of the character described that enables the trowel internal combustion motor to run constantly within an optimum RPM and horsepower range.

Yet another object is to provide a power steering riding trowel wherein the rotors flatten the concrete surface sufficiently to attain the high "F-numbers" (i.e., flatness characteristics) that are established by ACI regulations.

Another object is to provide a multiple-rotor, high power riding trowel that is inherently stable and easy to maneuver.

A related object is to provide multiple-rotor riding trowels that are ideal for pan finishing and quick curing concrete jobs.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, and in which like reference numerals have been employed throughout in the various views wherever possible.

DETAILED DESCRIPTION

Figure 3:
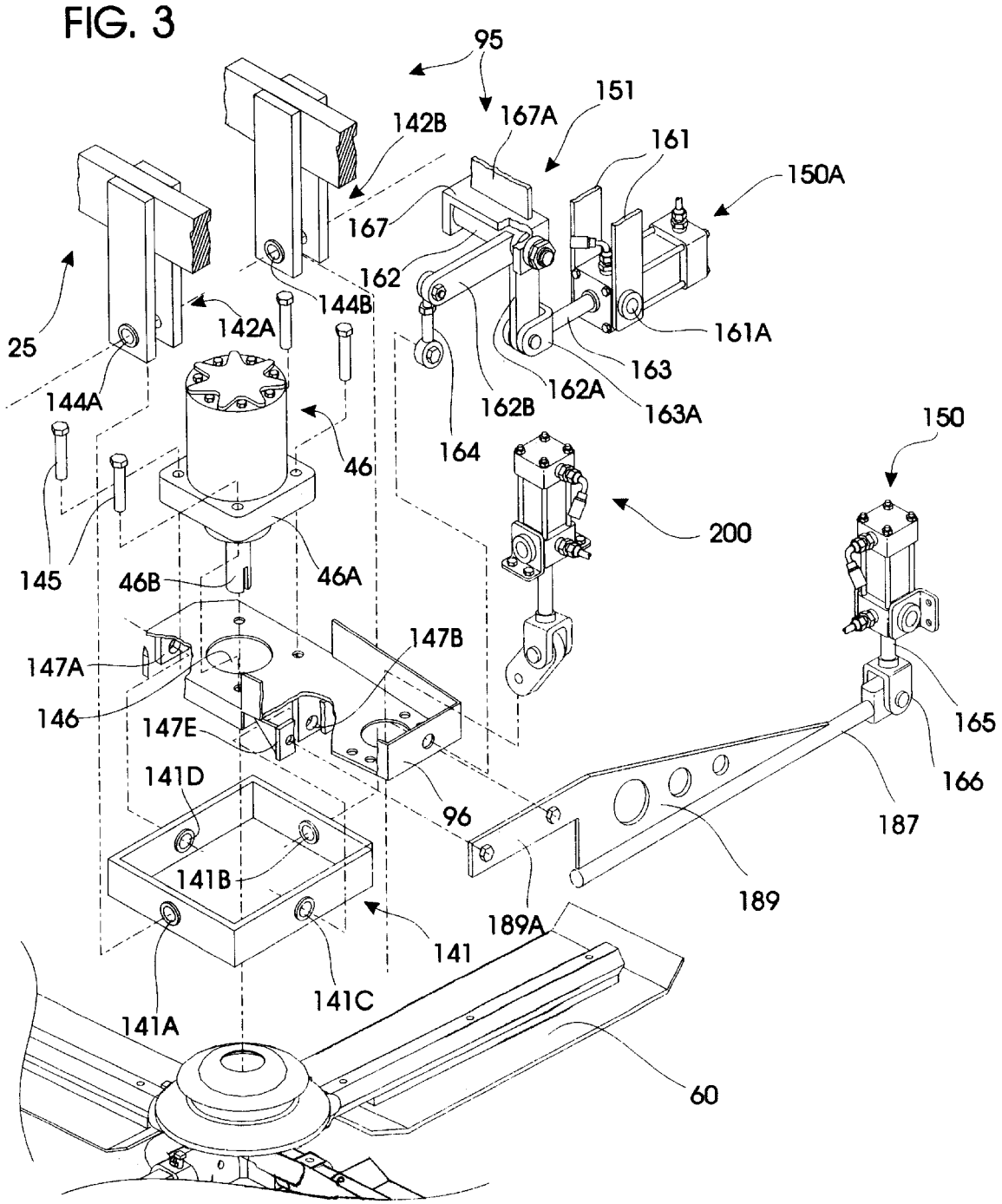
FIG. 3 is an enlarged, fragmentary, isometric exploded view showing preferred hydraulic drive motor components, steering linkages, and associated hydraulic controls.
Figure 4:
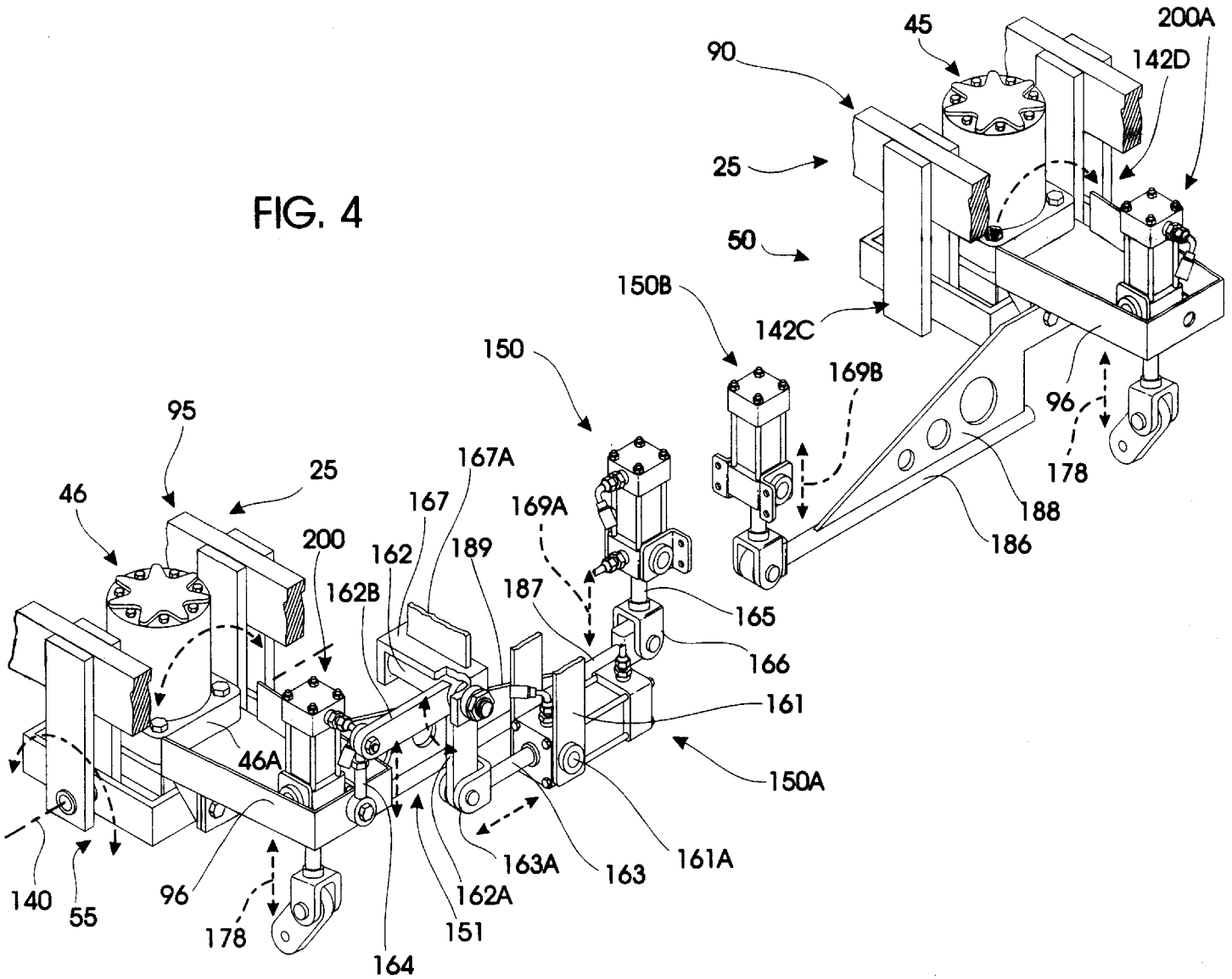
FIG. 4 is an enlarged, fragmentary, isometric view showing a steering system for a twin-rotor trowel.

With initial reference now directed to FIGS. 1–4 of the accompanying drawings, a multiple rotor riding trowel 20 broadly designated by the reference numeral 20 features a new hydraulic drive system (FIG. 3) and a complimentary hydraulic steering system (FIG. 4). Substantial structural details of pertinent riding trowels are set forth in prior U.S. Pat. Nos. 5,108,220, 5,613,801, 5,480,257, and 5,685,667 which, for disclosure purposes, are hereby incorporated by reference herein.

Riding trowel 20 comprises a metal frame 25 (FIGS. 1, 4) surrounded by a guard cage 30 (FIGS. 1, 2) defining its periphery. A pair of spaced apart rotor assemblies 50, 55 are gimbaled to the frame and project downwardly into contact with concrete surface 23. Several radially spaced apart blades 60 extend outwardly from each of the rotors 50, 55. The blades 60 frictionally contact the concrete surface 23 to be finished and support the trowel 20 and the operator.

An operator station 65 mounts at the top of the frame. At least one internal combustion engine 40 secured to the frame beneath the operator station 65 is employed for powering left and right hydraulic drive motors 45, 46 respectively that control rotor assemblies 50, 55. In the best mode the rotors use contra-rotation, as described in U.S. Pat. No. 5,685,667 which is incorporated by reference herein. However, it will be appreciated that the hydraulic steering and drive systems of the present invention may be used with riding trowels, with either normal or contra rotation, and with one or more gasoline, diesel powered, or alternative engines.

Figure 1:
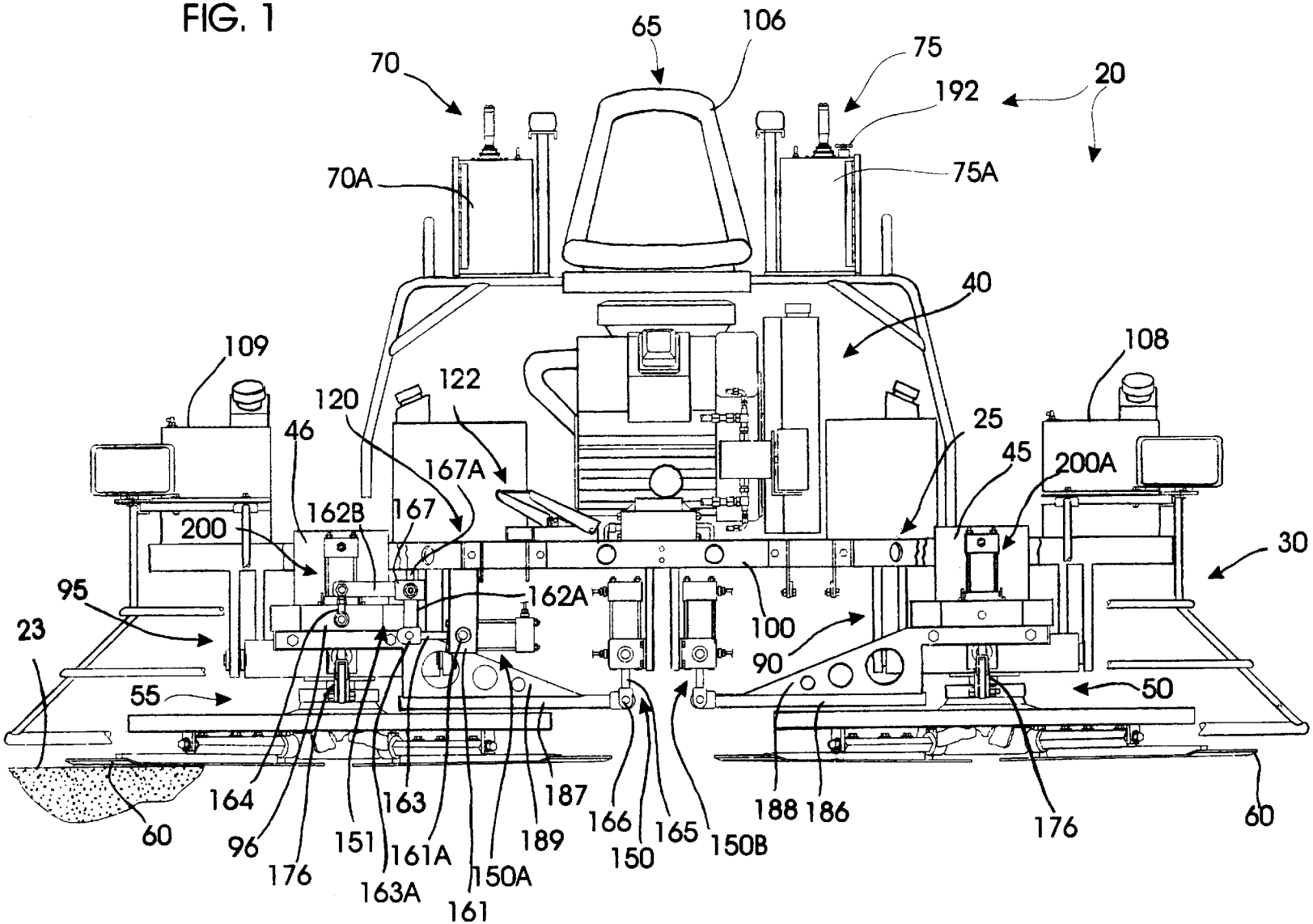
FIG. 1 is a partially fragmentary, front elevational view of a Hydraulically Driven, Multiple Rotor Riding Trowel, with portions thereof omitted or broken away for clarity.
Figure 2:
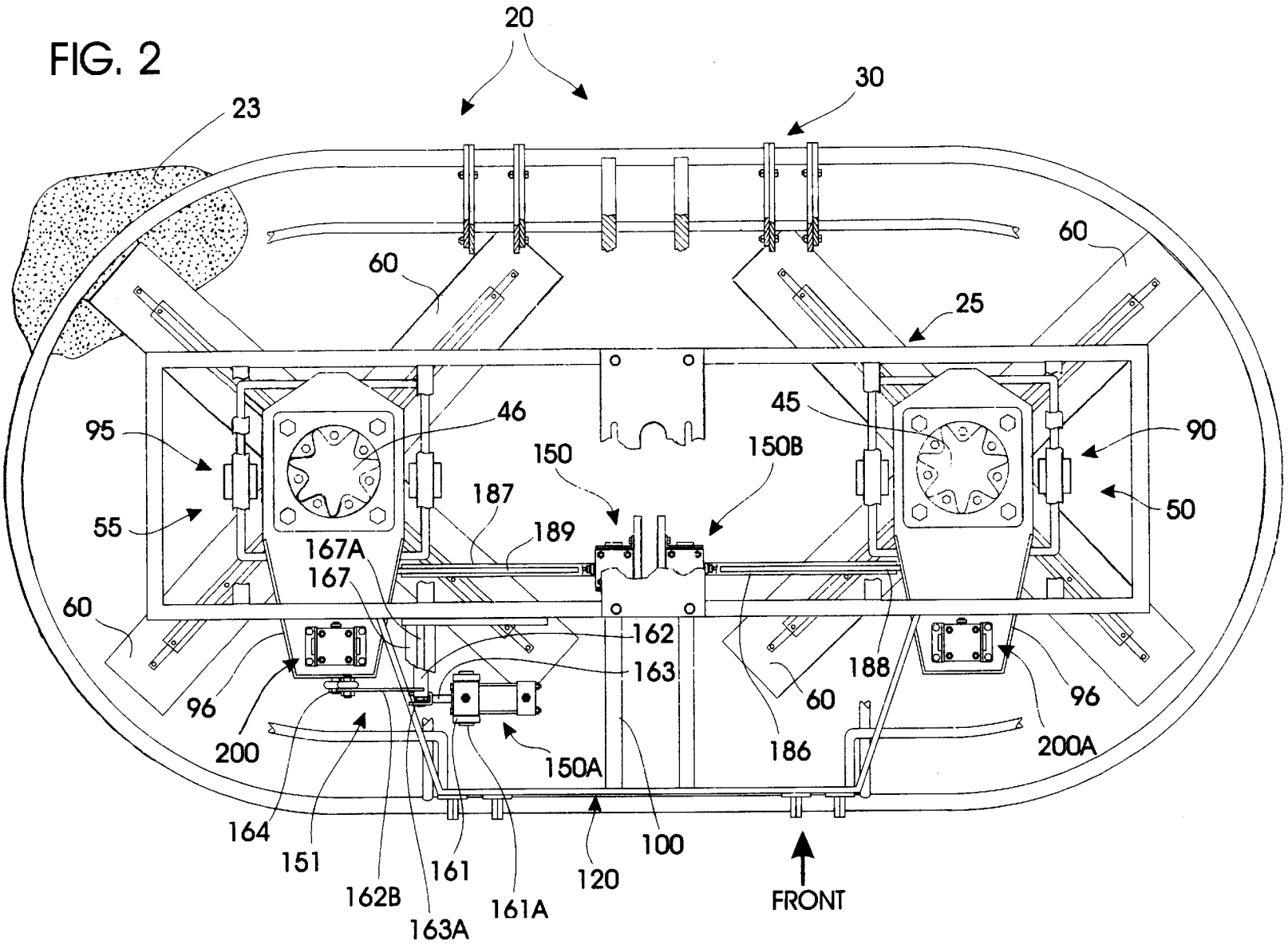
FIG. 2 is a fragmentary, top plan view of a trowel with portions thereof broken away or shown in section for clarity.

The controls are easily reached by a seated operator at station 65. In the best mode the operator steers trowel 20 with joysticks 70, 75 (FIG. 1). Left joystick 75 and right joystick 70 (i.e., from the point of view of a seated operator) respectively control steering apparatus associated with left rotor 50 and right rotor 55 respectively. Left joystick 75 and right joystick 70 are secured to control housings 75A and 70A respectively. As described later, the two-way left joystick 75 operates electric circuit 400 seen in FIG. 7; the four-way right joystick 70 operates the electric circuit 300 of FIG. 6. Right joystick 70 can be pushed forwardly or pulled rearwardly to move the trowel frontward or backwards; it may be moved to the operator's left and right for maneuvering, turning or crabbing. In the best mode known to us at this time left joystick 75 (FIG. 1) need only move forwards or backwards. Electrical circuits 300 and 400 (FIGS. 6, 7) operate hydraulic steering system 220 (FIG. 5) to tilt the hydraulic motors 45, 46 to control machine steering and maneuvering.

System 220 also controls blade pitch by operating blade pitch forks 176 (FIG. 1). The gimbal mounting systems 90, 95 respectively mount left and right hydraulic rotor-drive motors 45, 46 (FIG. 4). The gimbal system controls the angle or degree of tilt of the rotors 50, 55 to generate steering and propulsion forces as is known in the art.

The frame 25 comprises an upper deck 100 (FIG. 1) that provides a mounting surface for station 65. A seat 106 on station 65 permits the operator to ride the trowel. Conventional engine controls and gauges (not shown) are conveniently mounted adjacent the seat 106 within or upon housings 70A, 75A. Two gas tanks 108 and 109 are mounted on opposite frame ends. A forward subframe 120 projecting from the frame 25 mounts a throttle pedal 122. The throttle peddle 122 controls the flow of fuel from the gas tanks 108, 109 to the internal combustion engine 40 to ensure that the rotors 50, 55 (FIG. 1) rotate substantially uniformly at a high power RPM setting.

With joint reference to FIGS. 3 and 4, gimbal systems 90 and 95 are similar. Preferably, both gimbal systems 90, 95 tilt left and right in a plane parallel with the biaxial plane (i.e., the hypothetical plane established by the axis of rotation of both rotors). Additionally, right gimbal system 95 tilts front to back (and back to front) in a plane perpendicular to the biaxial plane. When deflected by cylinders 150 or 150B, the elongated torque rods 187 or 186 (FIG. 4) respectively extending from gimbal systems 95, 90 tilt the rotors in a plane parallel with the biaxial plane. The torque rods 186, 187, that function as the preferred levers, are generally aligned and extend along the bottom of gussets 188, 189. The rods 186, 187 are also forwardly offset from the axis of rotation 140 (FIG. 4) of the gimbal systems. Gimbal system 95 can be tilted in a plane perpendicular to the biaxial plane with hydraulic cylinder 150A that lifts or lowers rocking plate 96 through linkage 151 (FIG. 4).

Cylinder 150A is preferably oriented horizontally for clearance purposes (FIG. 4). It is secured between braces 161 by pivot 161A. Ran 163 terminates in a clevis 163A pivoted to arm 162A that is welded to sleeve 162. Housing 167 suspended from depending tab 167A (FIGS. 3, 4) rotatably captivates sleeve 162. Horizontally extending arm 162B emanating from sleeve 162 is radially deflectable. It drives a Heim joint 164 coupled to rocking plate 96. Cylinder 150A thus rocks plate 96 to tilt the right side gimbal system in a plane perpendicular to the biaxial plane. Alternatively, cylinder 150A could be oriented vertically, obviating the need for linkage 151.

Cylinders 150 and 150B (FIG. 4) lift the torque rods 187 or 186 to forcibly rock the rotors 55, 50 respectively in a plane parallel with the biaxial plane. The latter cylinders are preferably mounted vertically. The terminal clevis 166 on ram 165, for example, is directly pivoted to the end of torque rod 187. Thus a rocking movement in the direction of arrows 169A, 169B (FIG. 4) is established.

Blade pitch control cylinders 200, 200A are also mounted vertically. These change blade pitch by moving the forks 176, producing displacements as illustrated by arrows 178 (FIG. 4). Trowel blade pitch control is thoroughly discussed in the previously cited patent documents.

With emphasis now on FIG. 3, a preferred gimbal mounting system 95 comprises a generally rectangular subframe 141 whose sides are provided with bearing orifices 141A, 141B, 141C, and 141D. Subframe 141 is pivotally suspended below the frame between spaced apart bracket pairs 142A, 142B that mount aligned bearing orifices 144A, 144B. Subframe bearing orifices 141A and 141B register with bearing orifices 144A, 144B and, when pinned with a suitable axle 140 (FIG. 4), jointly establish an axis of rotation (i.e. about axle 140) that enables the right rotor (and right hydraulic motor 46) to pivot in a plane generally perpendicular to the biaxial plane. A subframe in left gimbal system 90 similar to subframe 141 mounts left hydraulic motor 45, but it can be welded to corresponding bracket pairs 142C and 142D (FIG. 4) as it need not pivot in a plane perpendicular to the biaxial plane.

The right hydraulic motor 46 comprises a rigid, peripheral mounting flange 46A (FIG. 3) enabling it to be mounted to rocking plate 96 by suitable bolts 145. The motor output shaft 46B projects concentrically through clearance orifice 146 in rocking plate 96 and is attached to the blade assembly to control blades 60 (FIG. 1). Apertured mounting tabs 147A and 147B projecting downwardly from rocking plate 96 register with subframe orifices 141C and 141D (FIG. 3) and pivotally mount the rocking plate over the subframe 141. An axis of rotation established by the pivot through subframe orifices 141C, 141D facilitates rocking of the right hydraulic motor 46 in a plane parallel with the biaxial plane. Such pivoting is caused by hydraulic cylinder 150 acting through torque rod 187 whose gusset tab portion 189A is secured beneath rocking plate 96 to downwardly projecting flanges 147E. Left hydraulic drive motor 45 is similarly gimbaled for pivoting in a plane parallel with the biaxial plane.

Figure 5:
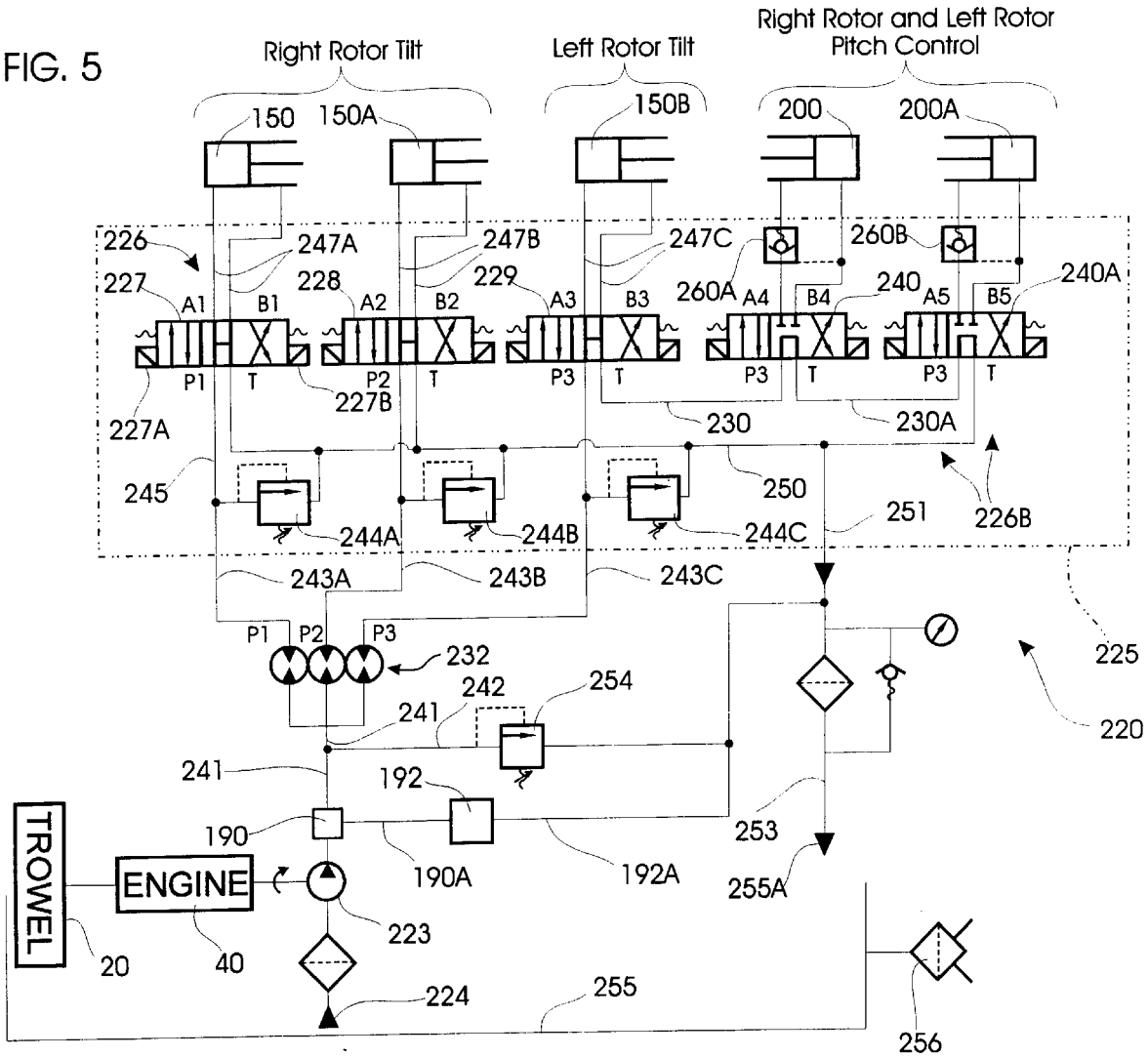
FIG. 5 is a schematic diagram of the preferred hydraulic steering circuit.

Referring now to FIG. 5, hydraulic tilting circuit 220 is responsible for rotor tilting for steering and maneuvering, and for blade pitch control. Hydraulic pump 223 driven by the internal combustion motor 40 on trowel 20 circulates fluid stored in reservoir 255, suctioning as indicated by arrowhead 224. Pump output reaches T-fitting 190 coupled to variable bypass needle valve 192 via passage 190A. Valve 192 is adjustable, and it is preferably mechanically located on the top of the trowel on cabinet 75A adjacent the driver so he can adjust his steering response speed. Valve 192 drains through line 192A to the hydraulic return 253. Valve 192 is preferably connected forwardly of the flow divider 232, as illustrated in FIG. 5.

The hydraulic flow rate and load experienced by the trowel depends upon numerous factors including the type of blade or pans chosen, the weight of the operator, and the hardness of the concrete being treated. Valve 192 provides a convenient means for the driver to quickly adapt flow rates to his operating conditions. It is preferred that this bypass valve be plumbed in immediately after the pump and before the flow dividers.

The main solenoid control valves are arranged in a manifold identified schematically by the reference numeral 225 that comprises steering valve bank 226 and blade pitch valve bank 226B (FIG. 5). Steering bank 226 is pressured through line 241 outputted from T-fitting 190 and lines 243A, 243B and 243C from the flow divider 232. Bank 226B, responsible for blade pitch, is connected to the "T" port of valve 229 on line 230. The pitch control solenoid valves 240 and 240A in bank 226B are interconnected by flow lines 230 and 230A.

Steering valve bank 226 (FIG. 5) preferably comprises a plurality of four way, three position, solenoid-actuated hydraulic valves 227, 228, and 229. The "T" ports of valves 227 and 228 are tied together. Valves 227, 228 are respectively connected to tilting cylinders 150, 150A that control right rotor tilting (FIG. 4). Valve 229 controls left rotor cylinder 150B, that rocks it in a plane parallel with the biaxial plane. Ports A1 and B1 of valve 227 control cylinder 150. Ports A2 and B2 of valve 228 control cylinder 150A, and ports A3 and B3 of valve 229 control cylinder 150B.

Pitch control bank 226B comprises solenoid activated hydraulic valves 240 and 240A. These respectively actuate right pitch control cylinder 200 and left pitch control cylinder 200A (i.e., FIGS. 4, 5). Ports A4 and B4 of valve 240, for example, control right pitch control cylinder 200 that controls blade pitch by hydraulically deflecting the pitch control fork. Ports A5 and B5 of valve 240A similarly control left pitch control cylinder 200A.

The hydraulic steering 223 (FIG. 5) transmits through line 241 to flow divider 232 that divides the hydraulic output into three equal flows. Flow from section one of divider 232 appears on line 243A and reaches cartridge relief valve 244A and port P1 of the four way valve 227 via line 245. Solenoid 227A establishes normal flow; solenoid 227B reverses the flow across ports A1 and B1. Similarly, the flow from sections two and three of divider 232 outputted on lines 243B and 243C respectively reaches cartridge relief valves 244B, 244C and solenoid valves 228, 229. Relief valves 244A–244C are set to 450 P.S.I. in the best mode. Valves 228 and 229 have similar solenoids that are electrically energized to reverse flow across their output ports A2, B2 and A3, B3 respectively. The double acting cylinders 150, 150A, 150B are thus extended or retracted. Each valve 227–229 has a pair of flexible lines 247A, 247B, 247C respectively interconnecting its output ports to the tilting cylinders 150, 150A, and 150B respectively. Right side steering is primarily established by valve 228 and cylinder 150A; right side forward/reverse control is primarily established by valve 227 that activates cylinders 150. Left rotor forward/reverse control is primarily established by valve 229 that tilts cylinder 150B (FIG. 4).

The hydraulic circuit return is completed by lines 250, 251 and 253 (FIG. 5). The main relief valve 254 is coupled across the circuit by line 242; in the best mode it is set at 550 P.S.I. Return to reservoir 255 is indicated by arrowhead 255A. Reservoir 255 is vented by breather 256. Electrical control will be detailed hereinafter. Valves 227, 228, and 229 operate similarly. The absence of solenoid control signals establishes a neutral steering position; cylinder deflection to a neutral position occurs because of the weight borne by the rotor assemblies.

The pitch control bank 226B is powered through the third section of flow divider 232 and the T port of valve 229 on lines 230 and 230A. Valves 240 and 240A control right pitch control cylinder 200 and left pitch control cylinder 200A respectively via their respective A and B ports. These valves have solenoids similar to solenoids 227A and 227B previously discussed. Pilot-operated check valves 260A and 260B hold the cylinders in position without drift.

Circuit 300 (FIG. 6) is operated by the right hand joystick 70 (FIG. 1). The right hand joystick 70 can be deflected between forward-neutral-reverse positions and left-neutral-right positions. The particular mechanical movement was selected for backwards compatibility with older twin rotor trowels; the joystick motions correspond generally with the mechanical hand-lever movements necessary for steering older twin rotor trowels.

In circuit 300 power (i.e., nominally 12 or 24 volts D.C.) is applied across lines 301 and 302. When the right joystick is moved forwardly switch contacts 303 close, activating solenoid field 305 that energizes solenoid 227A (FIG. 5) to pressure port A1 of valve 227 for forward steering. Moving the right joystick 70 rearwardly activates contacts 304 to energize solenoid field 306 and solenoid 227B (on valve 227), activating port B1 and reversing cylinder 150. Movement of the right joystick to the right activates solenoid field 308 through contacts 309 to activate port A2 on valve 228 for steering right (by tilting the right rotor assembly perpendicularly to the biaxial plane with cylinder 150A). Similarly, movement of the right hand joystick to the left activates solenoid field 310 through contacts 311 for steering left; at this time port B2 on valve 228 is pressured. Push button switch 314 (FIG. 6) operates relay 315 and LED indicator 316; relay 315 closes switch contacts 318 to energize the running lights 320. Other electrical accessories can be powered in this fashion.

The left, single-axis joystick 75 can be deflected between forward, neutral, and reverse selections. Again, the particular mechanical movement establishes backwards compatibility with older riding trowels. Blade pitch control switches are incorporated in the handle; there is a toggle control switch for pitch control of each rotor. The left hand joystick 75 (FIG. 1) operates circuit 400 (FIG. 7).

Figure 6:
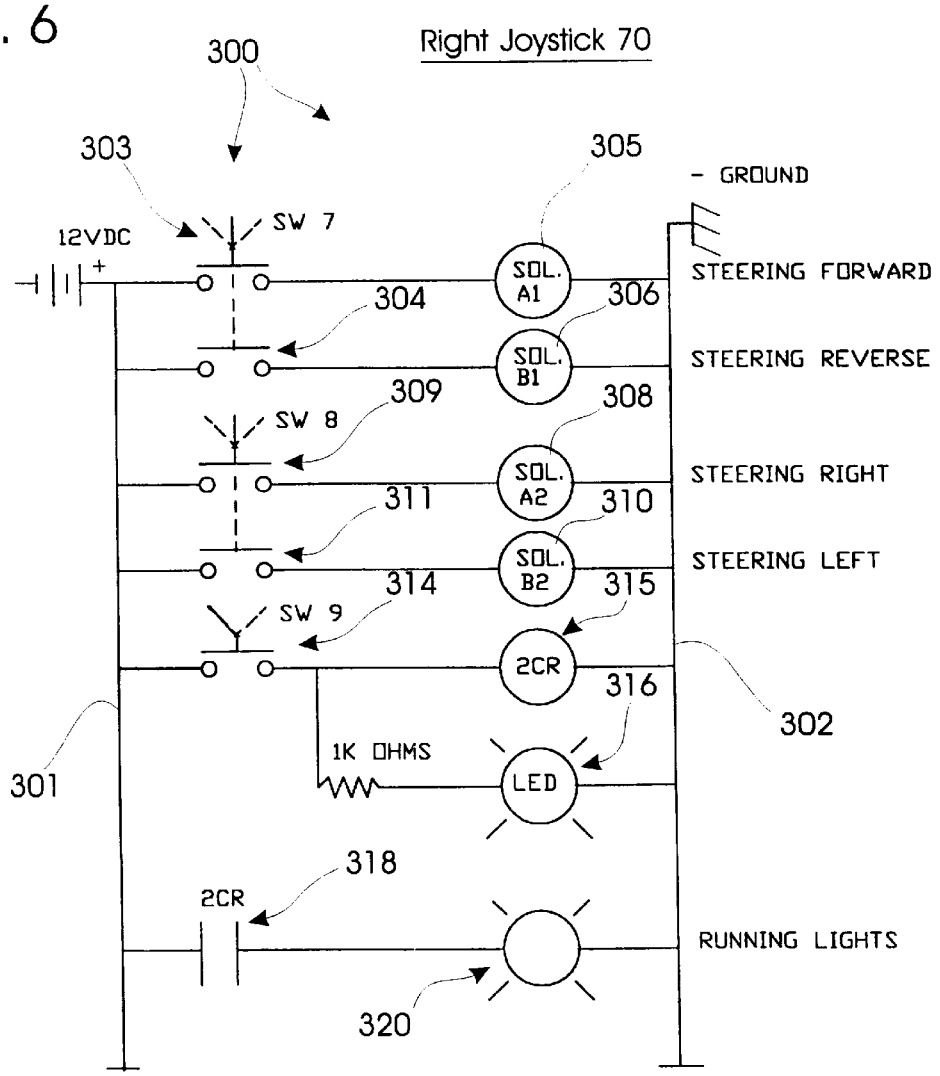
FIG. 6 is an electrical schematic diagram of the preferred right hand joystick control circuit.
Figure 7:
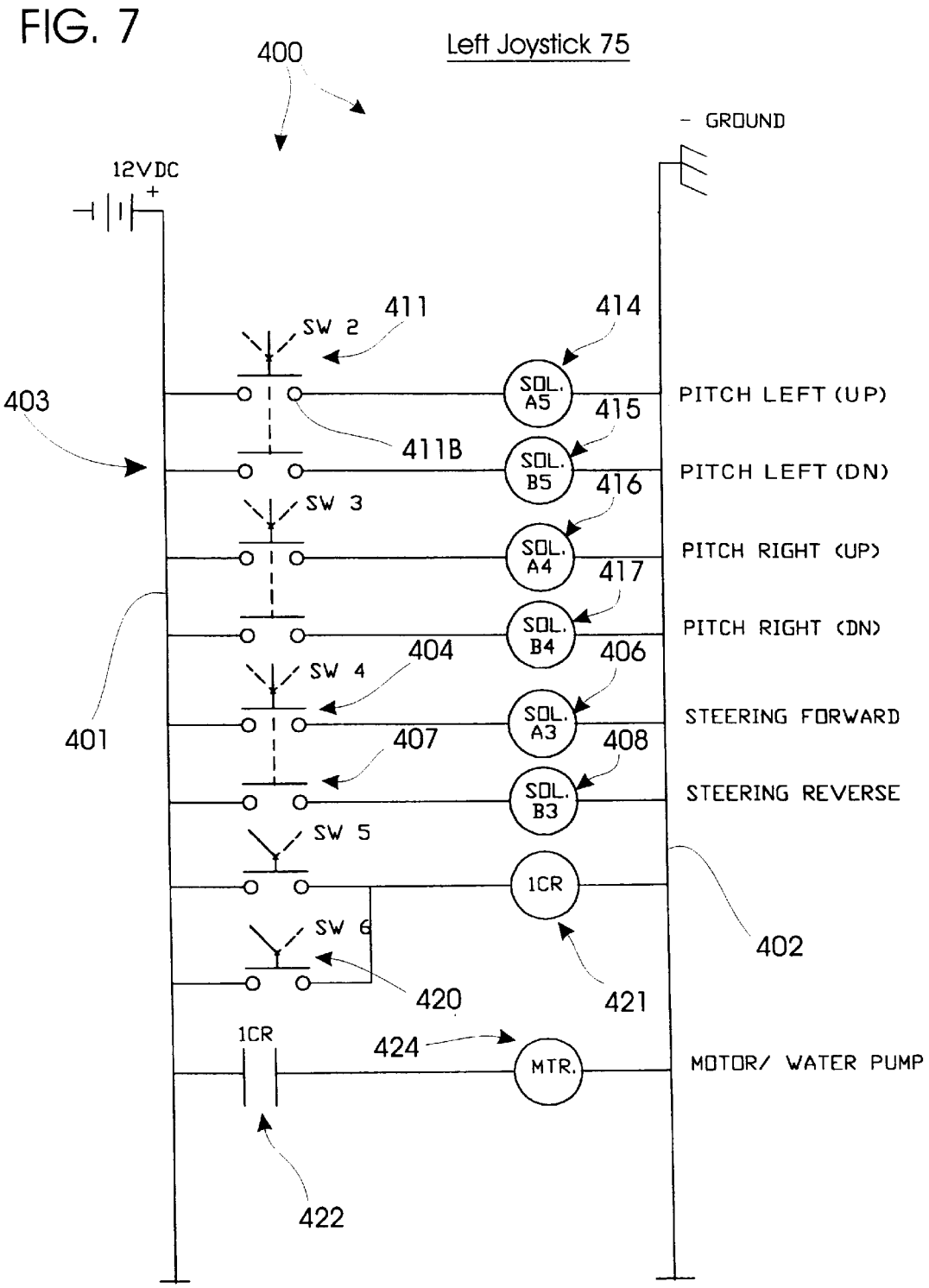
FIG. 7 is an electrical schematic diagram of the preferred left hand joystick control circuit.

In circuit 400 source voltage is applied across lines 401, 402 (FIG. 7). When the left joystick is pushed forwardly (i.e., concurrently with the right joystick) to move the trowel forwardly, contacts 404 are closed to energize solenoid field 406. This activates port A3 of valve 229 (FIG. 5) and cylinder 150B (FIG. 6). Pulling the left hand joystick rearwardly closes contacts 407 to energize solenoid field 408; this activates port B3 of valve 229 and retracts cylinder 150B, rocking the left rotor in the biaxial plane.

To control blade pitch it is preferred to use an electrical pitch control circuit generally designated by the reference numeral 403 (FIG. 7). A plurality of single pole double throw toggle switches 411 are preferred. When, for example, switch contacts 411B (FIG. 7) are closed to energize solenoid field 414, port A5 of valve 240A (FIG. 5) is activated to change blade pitch on the left rotor pitch control cylinder 200A (FIG. 4). Solenoid fields 415, 416, and 417 are similarly energized by the contacts and movements illustrated in FIG. 7. The respective solenoid valve "A" and "B" ports indicated in FIG. 5 correspond to the labeled ports in FIG. 7. Switch contacts 420 activate relay field 421 to close relay contacts 422, energizing an optional spray pump motor 424.

Figure 8:
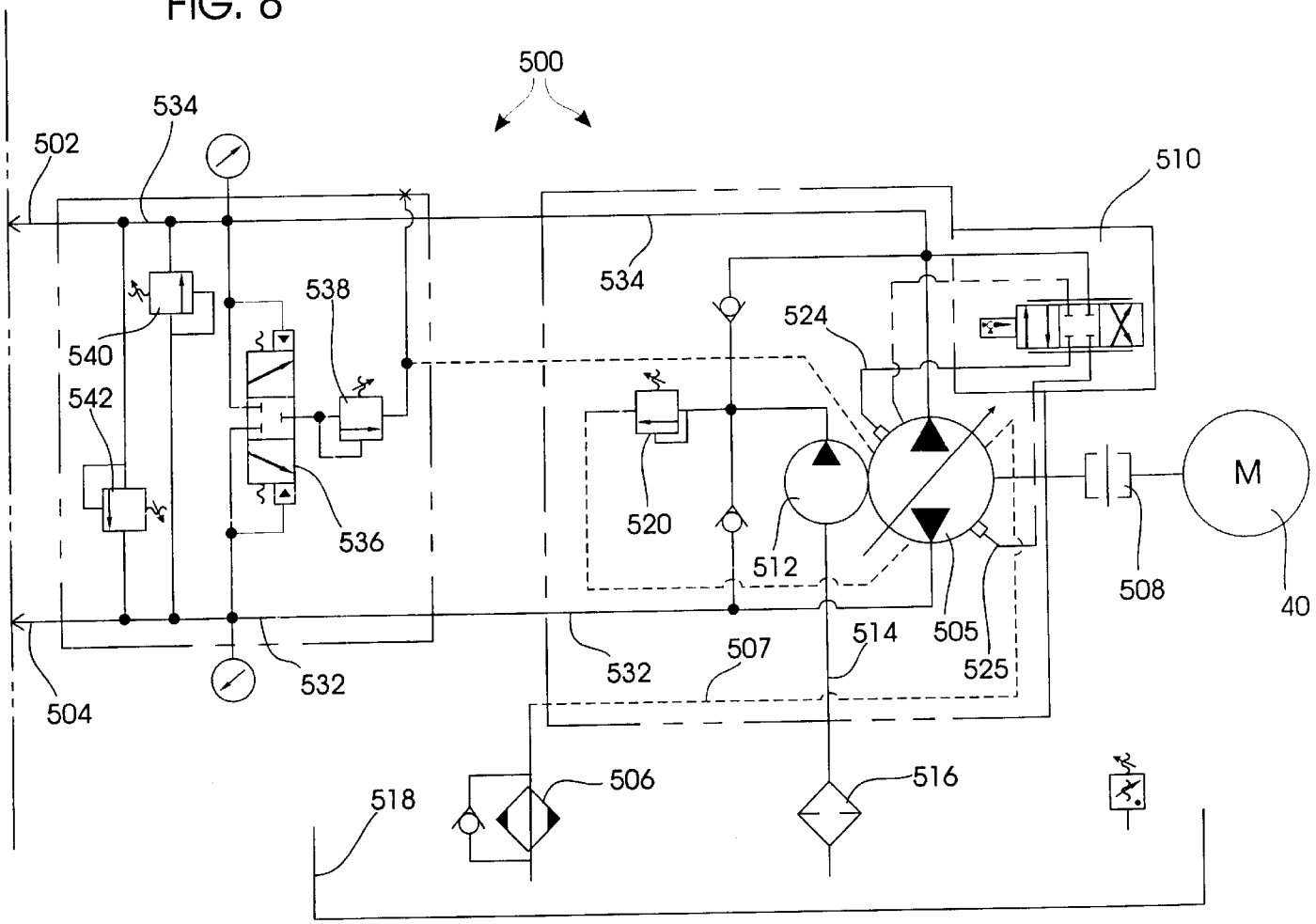
FIG. 8 is a schematic diagram of the preferred hydraulic motor control circuit; and, FIGS. 9 and 10 are schematic diagrams that supplement FIG. 8 and show possible twin-rotor and triple-rotor hydraulic motor arrangements.
Figure 9:
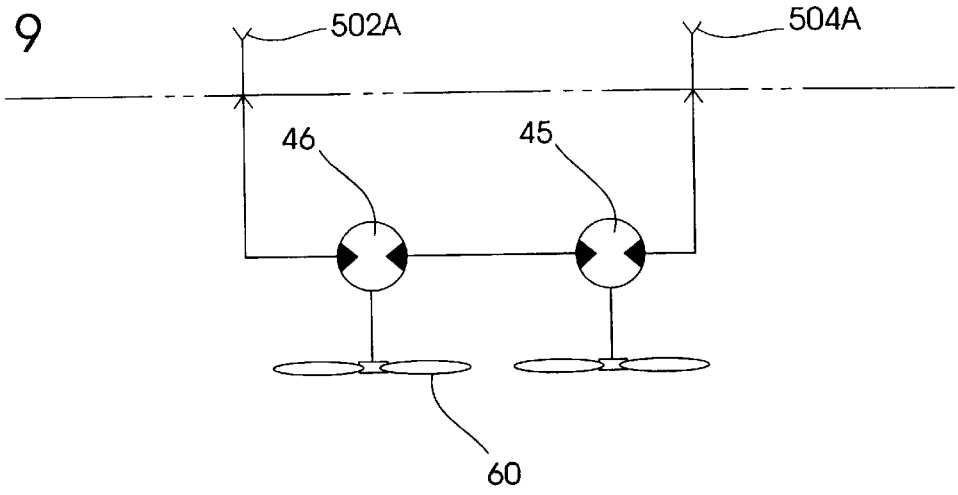
Figure 10:
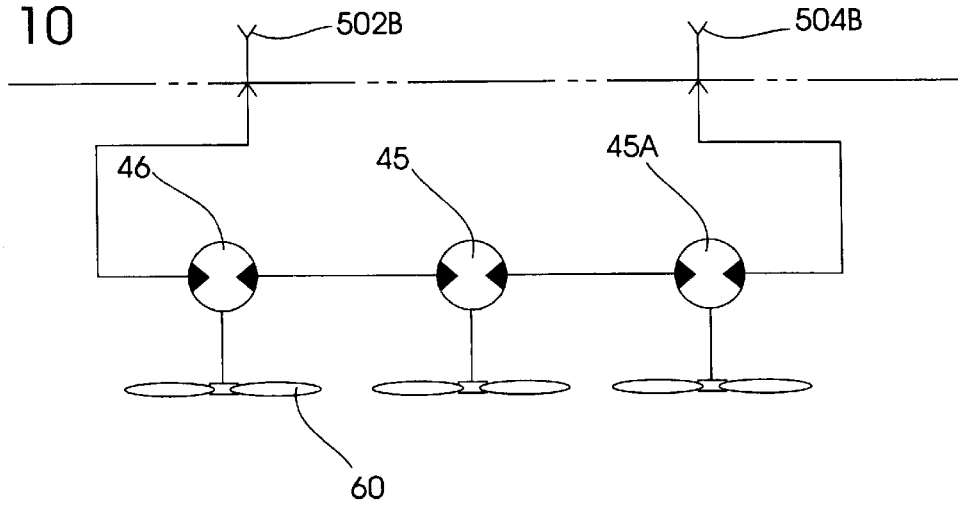

Referencing FIG. 8, the preferred hydraulic motor control circuit for powering a direct drive rotor motor 45, 46 has been designated by the reference numeral 500. It appears to us at this time that duplicate circuits should be used, one for each hydraulic rotor drive motor. Circuit 500 transmits fluid pressure across lines 502, 504 for powering a single hydraulic drive motor. Alternatively, if enough horsepower is developed, lines 502, 504 may be connected across lines 502A, 502B (FIG. 9) to power two series connected hydraulic drive motors; in the case of a three rotor trowel (i.e., with three direct drive hydraulic motors 45, 45A and 46), connection can be made to lines 502B, 504B (FIG. 10).

An internal combustion engine 40 drives a hydrostatic, bi-directional piston pump 505 through a mechanical coupling 508. The pump 505 is controlled by a servo pump control valve 510. An air cooled oil cooler 506 runs between reservoir 518 and the pump 505 via line 507. Charge pump 512 draws in fluid though line 514 and suction filter 516 that is in fluid flow communication with fluid reservoir 518. A charge pump relief valve 520 connected to pump 512 is responsible for setting control pressure. Control ports on pump 505 are connected across pump control valve 510 via lines 524, 525. Valve 510 may be remotely actuated by a suitable linkage (not shown) for controlling pressure (for speed control) by adjusting the swash plate position in pump 505. Depending upon the setting of valve 510, hydraulic pressure appears across lines 532 and 534, reaching hot oil shuttle valve 536 and hot oil purge relief valve 538. Cross over relief valves 540 and 542 connected across high pressure lines 532 and 534 provide overpressure protection for the closed loop design. It is preferred that excessive heat accumulated by the hydraulic fluid is dissipated; this is accomplished by the return loop created by valve 536.

Motor driving output lines 502 and 504 discussed previously connect to lines 534 and 532 respectively. Pump 505 is capable of delivering a variable hydraulic flow at a constant pressure, depending upon the setting of valve 510, which may be controlled electrically or manually to vary the rotor speeds. This creates variable rotor speed control at a constant torque output. Circuit 500 provides directional control, variable speed control, and relatively constant torque under varying speed conditions. During operation the internal combustion motor 40 provides substantially constant horsepower over an optimum RPM range.

A three rotor trowel with multiple hydraulic drive motors is seen in FIGS. 11–16. It is designed to quickly and reliably flat finish large areas of concrete surface 621. The triple-rotor trowel 620 is equipped with hydraulic steering and hydraulic pitch control, utilizing a hydraulic steering circuit substantially the same as that detailed in FIG. 5. Trowel 620 comprises a trio of separate rotor assemblies. Each rotor assembly is independently, pivotally gimbaled from the rigid frame and directly driven by a separate hydraulic motor 45, 45A and 46 (FIG. 10). In the best mode each hydraulic motor is powered by a separate circuit 500 (FIG. 8).

An operator (not shown) comfortably positioned upon seat assembly 623 can operate the entire machine with an easy-to-use lever controlling system comprising, in the best mode, left joystick 624B and right joystick 624A. The left hand joystick 624B is preferably wired according to circuit 400 (FIG. 7) and the right hand joystick 624A is preferably wired according to circuit 300 (FIG. 6). A foot-operated motor throttle control 674 (FIG. 11) is accessible from seat assembly 623 for throttling the internal combustion motor.

Figure 11:
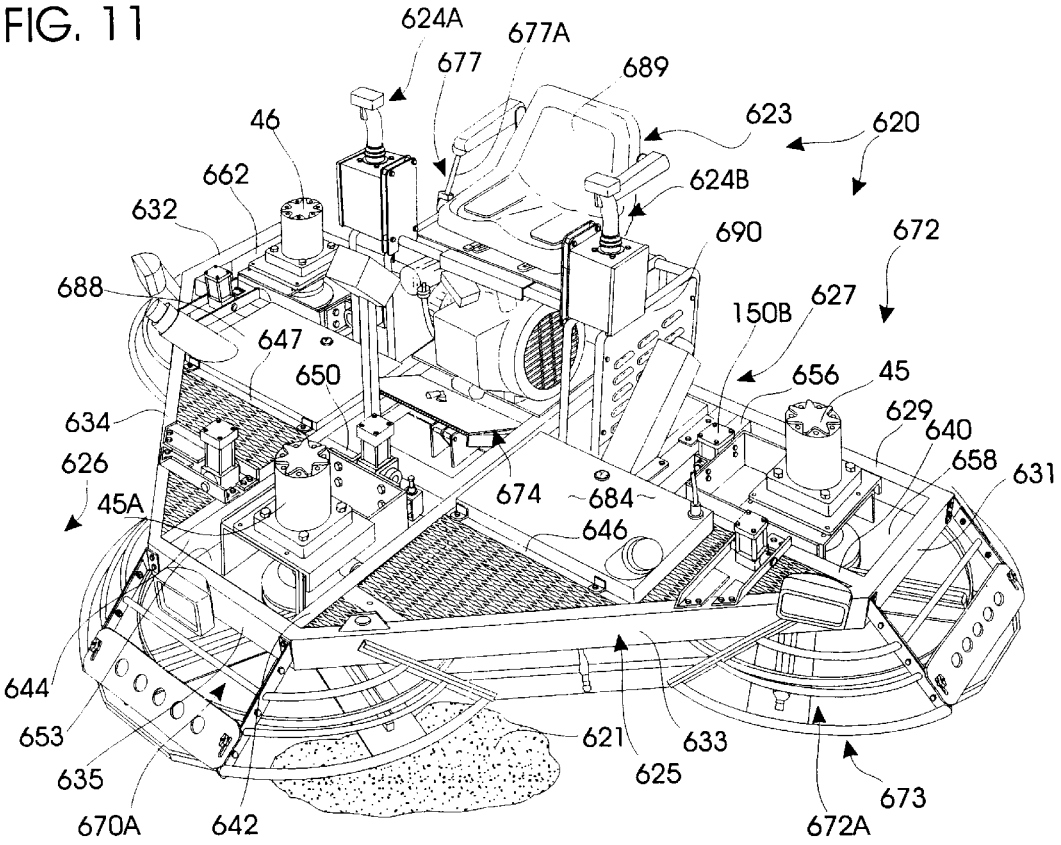
FIG. 11 is a front, environmental, perspective view of a high speed, triple rotor trowel with hydraulic direct drive and hydraulic steering, showing the best mode of the invention known at this time.
Figure 12:
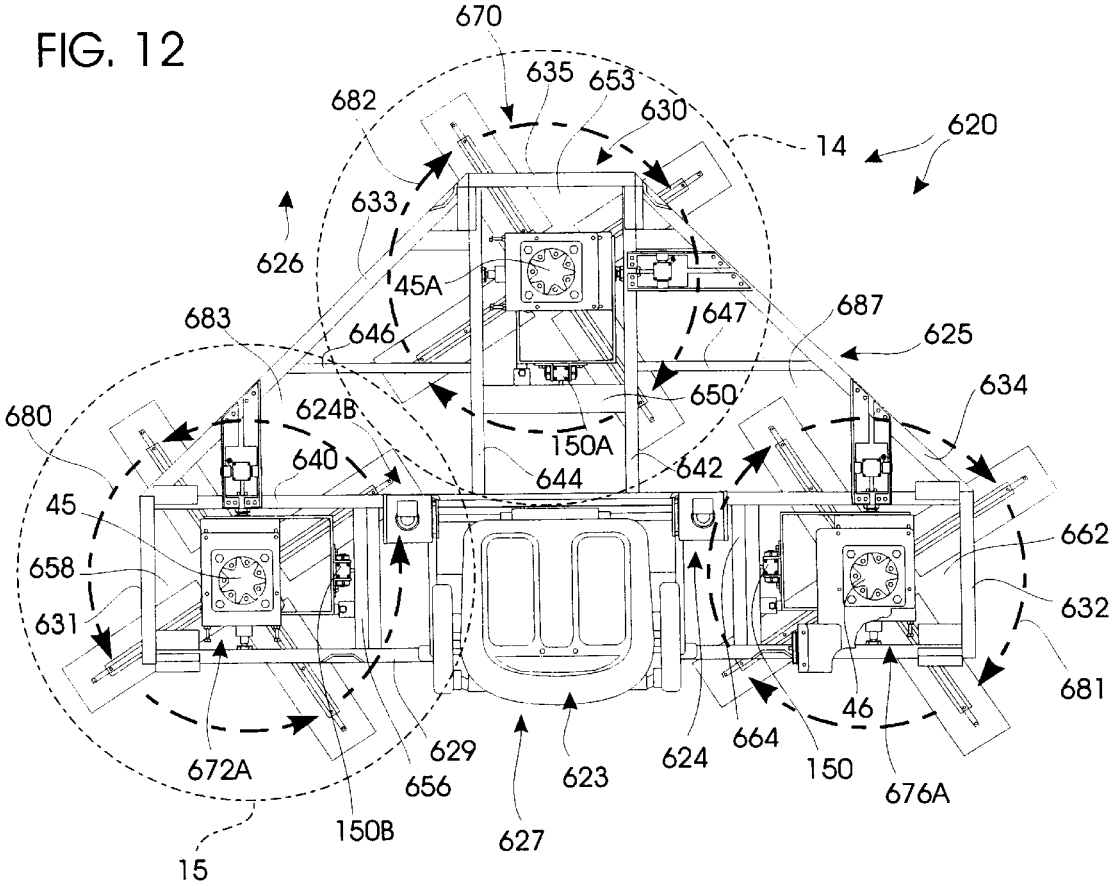
FIG. 12 is a fragmentary top plan view of the trowel of FIG. 11 with portions thereof omitted or broken away for clarity.
Figure 13:
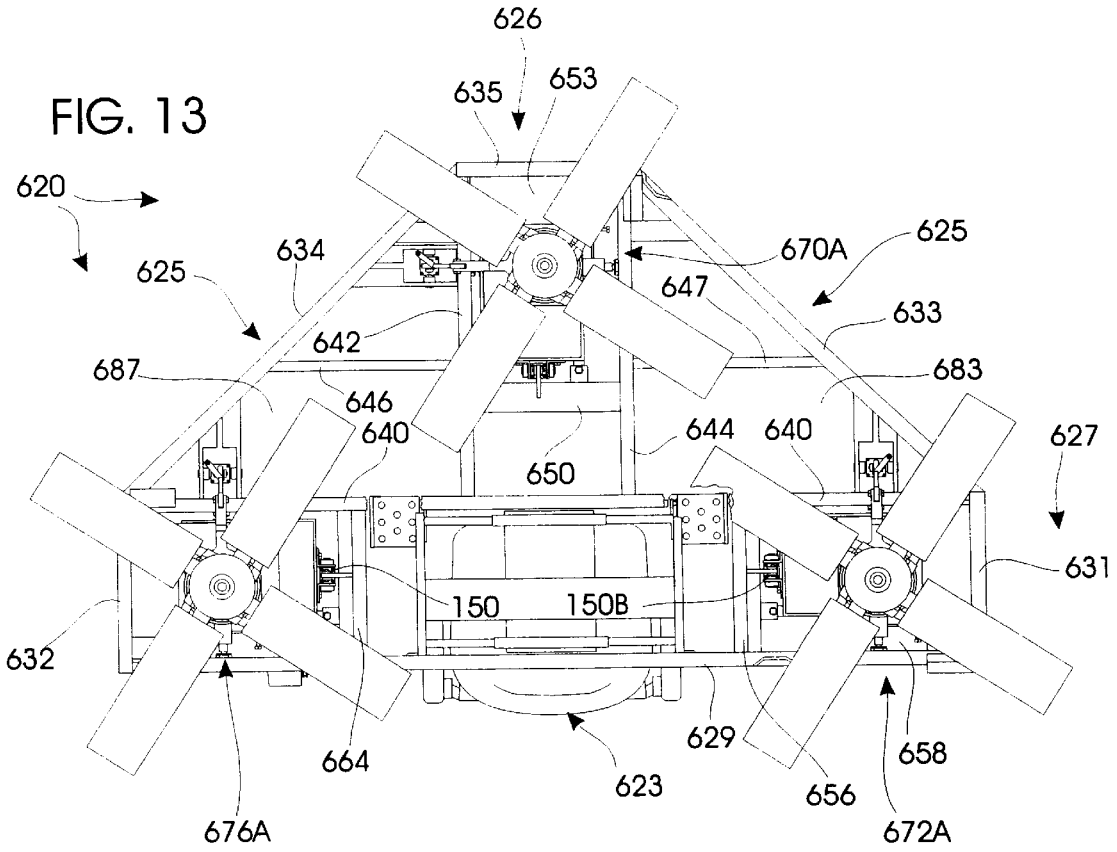
FIG. 13 is a fragmentary, bottom plan view of the trowel of FIG. 11 with portions omitted for clarity.

Trowel 620 has a rigid metallic frame 625 fabricated from channel steel. In the three rotor mode the frame is triangular, and comprises a front 626 (FIG. 1) and a rear 627 (FIG. 12). A transverse base 629 extends across the rear 627 of the frame between frame ends 631 (FIG. 11), and 632 (FIG. 12). Ends 631, 632 are rigidly affixed to frame sides 633, 634 (FIG. 14) which preferably form the sides of a triangle and terminate at a transverse, frame front 635 (FIGS. 11, 13). The frame is internally reinforced by transverse strut 640 (FIGS. 13, 14) that is parallel with and spaced apart from base 629. The parallel frame braces 642, 644 extend from strut 640 to front 635 to further reinforce the frame. Similarly, transverse struts 646, 647 (FIGS. 13, 14) extend between braces 644, 642 to sides 633, 634 respectively for reinforcement.

Figure 14:
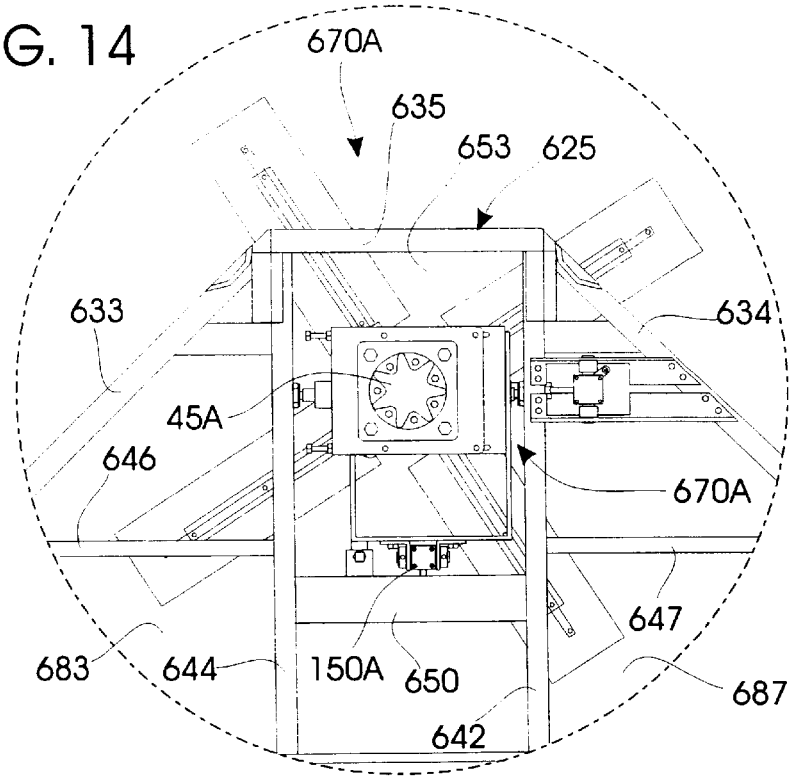
FIG. 14 is an enlarged, fragmentary, top plan view of circled portion 14 of FIG. 12, with portions thereof broken away for clarity or omitted for brevity; and, FIG. 15 is an enlarged, fragmentary top plan view of circled portion 15 in FIG. 12, with portions broken away for clarity or omitted for brevity.

An internal brace 650 that is parallel with and spaced apart from front 635 extends between braces 642, 644 (FIGS. 13, 14). A recessed hydraulic motor mounting region 653 is defined between brace 650, front 635 and braces 642, 644. In the best mode, each rotor assembly is pivotally disposed within a similar frame mounting region defined between adjacent and intersecting frame elements. The left rear of the frame is reinforced with a doubled, channel steel brace 656 (FIG. 16) that extends between frame base 629 and strut 640. A recessed hydraulic motor mounting region 658 (FIGS. 14, 16) for the left rear rotor is defined between frame end 631, brace 656, strut 640 and base 629. Similarly, recessed hydraulic motor mounting region 662 (FIG. 13) for the right rear rotor is defined between frame end 632, brace 664, strut 640 and base 629.

Figure 15:
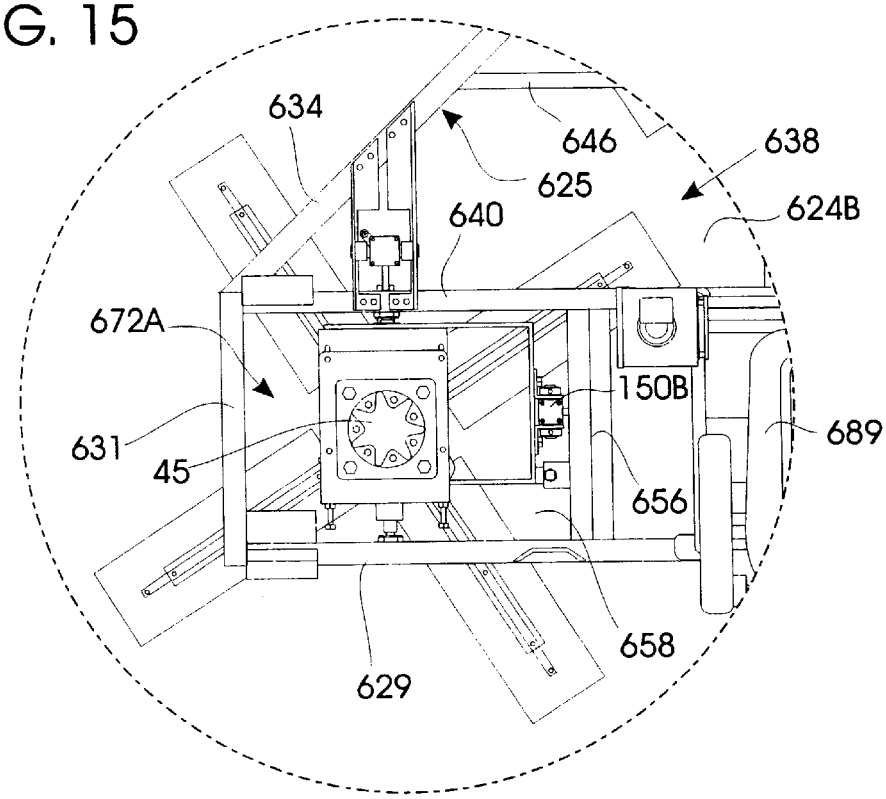

Trowel 620 comprises two spaced apart, bladed rotors at its rear and one at its front that support the trowel upon the concrete surface 621. Alternatively, as explained above, the steering system can be employed with trowels having more or less rotor assemblies. In the best mode known at this time, however, each rotor assembly of the hydraulic triple trowel 620 is driven by a separate hydraulic drive motor through a circuit 500 (FIG. 8). For example, in trowel 620 a front motor 45A drives a front rotor assembly 670A (FIGS. 14, 15). The left rear motor 45 drives rotor assembly 672A (FIGS. 11, 13). Similarly the right rear motor 46 independently drives rotor assembly 676A.

In the best mode the left and right rear rotors revolve in the opposite radial directions indicated by arrows 680, 681 (FIG. 13). The latter is termed "contra-rotation." Such rotation is also preferred with twin rotor trowels. In the best mode known to us at this time the front rotor (i.e., in a triple rotor trowel) revolves in a clockwise direction indicated by arrow 682 (FIG. 13). When the rear rotors revolve in this preferred "contra-rotation" mode, they press incoming concrete about the trowel periphery during forward trowel movement. However it is within the scope of the invention to employ "standard rotation" wherein the rear rotors revolve oppositely from arrows 680, 681. The latter, although not preferred, is referred to as "standard rotation." In the latter mode the rotors press incoming concrete toward the trowel center and between the rotors during forward movement. Standard rotation may be employed by twin rotor trowels as well.

Preferably, the rotor assemblies 670A, 672A and 676A are powered by hydraulic motors 45, 45A, 46 similar to those previously discussed and illustrated in FIGS. 3, 4. Each rotor is protectively shrouded by a cage assembly 673 that prevents human contact with the revolving rotor blades that frictionally finish the concrete surface.

A first fuel tank 684 (FIG. 11) is recessed within the frame area 683 defined between struts 640, and 646. A companion fuel tank 688 (FIG. 12) is mounted within mounting region 687 (FIG. 13) defined between internal frame struts 640, 647. The seat assembly 623 comprises a chair 689 disposed upon a ventilated, upright enclosure 690 positioned between the internal combustion motors 672, 676. Enclosure 690 houses a battery (not shown) for the electrical system hydraulic circuitry discussed previously. A cruise control 677 (FIG. 12) is accessible from the right side of the seat to lock in selected motor speed. Cables (not shown) from the variable foot control 674 (FIG. 1) establish motor speed by displacing the motor throttle linkages (not shown). Handle 677A may be conveniently grasped by the user to lock the throttles in a cruise control mode.

In the triple rotor design, each rotor pivots in a single direction. The left and rear rotor preferably tilt in a direction parallel with the biaxial plane established by three axis of rotation of the left rear and right rear rotor assemblies. Rocking is caused by cylinders 150, 150B (FIG. 4) that are associated with the right rear and left rear rotor assemblies respectively in the three rotor design. The front rotor assembly pivots in a direction perpendicular with the biaxial plane, in response to cylinder 150A, which in the three rotor design 620, is associated with the front rotor. As before, joystick operated circuits 300 and 400 control operation. Each rotor assembly also comprises a blade pitch control valve and fork system of the type discussed previously. As explained in copending application Ser. No. 08/784,244, Filed Jan. 15, 1997, Group Art Unit 3506, and entitled Hydraulically Controlled Riding Trowel, which is owned by the same assignee as in this case, an additional valve, functioning similarly to valves 240 and 240A in bank 226B, drives a cylinder similar to cylinders 200 and 200A to control pitch of the front rotor assembly. The last mentioned patent application is hereby incorporated by reference.

Operation

In operation a variety of operator precautions must be observed, as is the case with prior art motorized trowels. The hydraulic tanks should be periodically inspected for proper level, and the rotor blades must be changed as necessary after routine inspections for wear. Fuel tank levels must be sufficient for extended periods of use. During the initial finishing of wet concrete, proper pans will first be installed on the rotors by coupling the rotor blades to the radially spaced apart brackets provided.

If pressure is applied to the inside of the left and right rotors by tilting them appropriately with the double acting cylinders (i.e., by pulling the joysticks backwards), then the machine will move in reverse. To move left, with the rear rotors untilted (i.e., neutral) subsequent tilting of the right rotor by hydraulic cylinder 150 will cause the trowel to make a left hand, wide sweeping turn. With the rotors untilted in the biaxial plane (i.e., neutral) tilting of the right rotor (i.e., the front rotor in the triple trowel) to concentrate pressure at its rear (i.e., towards the interior of the riding trowel frame) will cause the trowel to make a right hand, wide sweeping turn. At this time the right hand joystick is moved to the right. As readily recognized by those skilled in the art, a variety of other trowel movements are possible by moving the joysticks generally in the same directions that old fashioned, lever-actuated trowels are driven.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A motorized riding trowel for finishing concrete, said riding trowel comprising:

a rigid frame;

hydraulic pump means for supplying hydraulic pressure;

internal combustion motor means secured to said frame for powering said pump means;

rotor means pivotally suspended from said frame for supporting said riding trowel and finishing said concrete, said rotor means comprising a plurality of radially spaced apart blades for frictionally contacting the concrete;

hydraulic drive motor means for rotating said rotor means;

hydraulic circuit means connected to said hydraulic pump means for controlling said hydraulic drive motor means, the hydraulic circuit means comprising a pair of output lines leading to said hydraulic drive motor means, and shuttle valve means connected across said output lines for dissipating excess heat by bleeding off hot oil; and, a power steering system comprising:

tilting cylinder means for tilting the rotor means to effectuate trowel steering and maneuvering;

hydraulic steering circuit means powered by said hydraulic pump means for activating the tilting cylinder means; and, left and right joysticks accessible to a trowel operator for selectively activating said steering circuit means, whereby the operator of the trowel can steer and control the riding trowel hydraulically.

2. The trowel as defined in claim 1 wherein said hydraulic circuit means comprises second cylinder means for varying rotor assembly blade pitch, whereby the operator of the trowel can change riding trowel blade pitch hydraulically.

3. The trowel as defined in claim 1 further comprising servo pump control valve means for controlling the speed of the trowel by adjusting swash plates in said hydraulic pump means.

4. A motorized riding trowel for finishing concrete, said riding trowel comprising:

a rigid frame;

spaced apart rotor assemblies projecting downwardly from said frame for powering said riding trowel, each rotor assembly comprising a plurality of radially, spaced-apart blades for frictionally contacting the concrete surface, each rotor assembly powered by a hydraulic motor;

tilting cylinder means for selectively tilting said rotor assemblies for steering and maneuvering the trowel;

internal combustion motor means for powering the trowel;

hydraulic pump means driven by said internal combustion motor means for providing hydraulic pressure;

steering circuit means in fluid flow communication with said hydraulic pump means for controlling said tilting cylinder means;

joystick means accessible to the trowel operator for operating said steering circuit means, whereby the operator of the trowel can steer and control the trowel hydraulically;

hydraulic circuit means for controlling the hydraulic drive motors, the hydraulic circuit means comprising a pair of output lines, and valve means connected across said output lines for dissipating excess heat by bleeding off hot oil.

5. The trowel as defined in claim 4 further comprising pitch control cylinder means for varying rotor assembly blade pitch.

6. The trowel as defined in claim 4 wherein said hydraulic circuit means comprises second cylinder means for varying rotor assembly blade pitch, whereby the operator of the trowel can change riding trowel blade pitch hydraulically.

7. The trowel as defined in claim 4 wherein further comprising servo pump control valve means for controlling the speed of the trowel by adjusting swash plates in said hydraulic pump means.

* * * * *